US005233101A

United States Patent [19]

Harandi

[11] Patent Number: 5,233,101

[45] Date of Patent: Aug. 3, 1993

[54] FLUIDIZED CATALYST PROCESS FOR PRODUCTION AND HYDRATION OF OLEFINS

[75] Inventor: Mohsen N. Harandi, Langhorne, Pa.

[73] Assignee: Mobil Oil Corporation, Fairfax, Va.

[21] Appl. No.: 958,829

[22] Filed: Oct. 9, 1992

[51] Int. Cl.[5] ..... C07C 29/04; C07C 31/125; C07C 4/02

[52] U.S. Cl. ..... 568/897; 568/899; 585/648; 585/752

[58] Field of Search ..... 568/897, 899; 585/648, 585/752

[56] References Cited

U.S. PATENT DOCUMENTS

| | | | |
|---|---|---|---|
| 2,477,380 | 7/1949 | Kreps et al. | 260/641 |
| 3,493,518 | 2/1970 | Jonassen et al. | 568/897 |
| 3,912,463 | 10/1975 | Kozlowski et al. | 44/56 |
| 3,989,762 | 11/1976 | Ester | 260/641 |
| 4,214,107 | 7/1980 | Chang et al. | 568/897 |
| 4,334,890 | 6/1982 | Kochar et al. | 44/53 |
| 4,423,251 | 12/1983 | Pujado et al. | 568/697 |
| 4,484,013 | 11/1984 | Schmidt | 568/899 |
| 4,499,313 | 2/1985 | Okumura et al. | 568/897 |
| 4,783,555 | 11/1988 | Atkins | 568/695 |
| 5,144,086 | 9/1992 | Harandi et al. | 568/897 |
| 5,157,178 | 10/1992 | Gajda et al. | 568/697 |

FOREIGN PATENT DOCUMENTS 133661 1/1979 Fed. Rep. of Germany .

*Primary Examiner*—Joseph E. Evans
*Attorney, Agent, or Firm*—Alexander J. McKillop; Malcolm D. Keen; L. G. Wise

[57] ABSTRACT

An improvement in iso-olefin hydration is obtained in an integrated process combining a fluidized catalytic cracking reaction and a fluidized catalyst hydration reaction wherein zeolite catalyst particles are withdrawn in partially deactivated form from the alkanol reaction stage and added as part of the catalyst in the FCC reaction.

19 Claims, 2 Drawing Sheets

FLUIDIZED CATALYST PROCESS FOR PRODUCTION AND HYDRATION OF OLEFINS

FIELD OF THE INVENTION

The present invention relates to a multi-stage process for cracking hydrocarbons and preparing tertiary alkanols ($C_4$+lower alkyl alcohols). More particularly, it relates to a technique for utilizing zeolite catalyst used in preparing alkanols as makeup or equilibrium catalyst for large scale catalytic operations employing solid particulate catalyst materials, especially fluidized catalytic cracking (FCC) processes.

BACKGROUND OF THE INVENTION

This invention relates to a catalytic technique for cracking heavy petroleum stocks and converting olefin gas to valuable alkanols. In particular, it provides a continuous integrated process for reacting olefinic light gas byproduct of hydrocarbon cracking by hydration to produce $C_5$+ alkanols Isobutylene and/or isoamylene containing streams, byproducts of petroleum cracking in a fluidized catalytic cracking (FCC) unit or thermal cat cracking (TCC) unit, may be upgraded to alkanols by contact with a solid acid catalyst, such as crystalline medium pore siliceous zeolite catalyst. Primary emphasis herein is placed on the preferred FCC catalyst, which is readily transportable and commercially available.

Alkanols, such as t-butanol (tertiary-butyl alcohol, "TBA") and t-amyl alcohol ("TAA"), can be produced from FCC iso-olefins by catalytic conversion in a fluidized bed of solid medium pore acid zeolite catalyst. Such a fluidized bed operation typically requires oxidative regeneration of coked catalyst to restore zeolite acidity for further use, while withdrawing spent catalyst and adding fresh acid zeolite to maintain the desired average catalyst activity in the bed. This technique is particularly useful for upgrading FCC light olefinic gas, which usually contains significant amounts of $C_4$ olefins, including isobutene.

Economic benefits and increased product quality can be achieved by integrating the FCC and hydration units in a novel manner. It is the primary object of this invention to eliminate the hydration catalyst regeneration system which results in significant process investment saving and improved process safety. Another object of this invention is to eliminate the hydration catalyst regeneration which results in significant process investment/operating cost saving. Another object of the present invention is to further extend the usefulness of the medium pore acid zeolite catalyst used in the alkanol reaction by withdrawing a portion of partially deactivated and coked zeolite catalyst and admixing the withdrawn portion with cracking catalyst in a primary FCC reactor stage. The catalyst withdrawn from the hydration unit operations can be sent directly to the FCC reactor or regenerator; however, it is also feasible to employ the catalyst in other intermediate unit operations, such as olefin upgrading. Prior efforts to increase the octane rating of FCC gasoline by addition of zeolites having a ZSM-5 structure to large pore cracking catalysts have resulted in a small decrease in gasoline yield, increase in gasoline quality, and increase in light olefin byproduct.

Recent efforts have been made in the field of gasoline blending to increase gasoline octane performance without the addition of deleterious components such as tetraethyl lead and benzene. It has been found that lower molecular weight $C_4$–$C_9$ alkanols, such as TBA and TAA can be added to $C_5$–$C_{90}$ hydrocarbon-containing gasoline products. Conventional hydration processing uses as catalyst a macroreticular cation exchange resin in the hydrogen form. An example of such a catalyst is "Amberlyst 15". A resin catalyst gives a high conversion rate but is unstable at elevated temperatures (above about 90° C.). When overheated, the resin catalyst releases sulfonic and sulfuric acids. In addition leaching of acid substances from the resin catalyst even at normal operating temperatures causes a reverse reaction—decomposition of alcohol products to starting materials—to occur upon distillation of product. Overall yield can be significantly decreased.

Hydration reactions conducted over a resin catalyst such as "Amberlyst 15" are usually conducted in the liquid phase at temperature of about 40° to 80° C. and at a pressure of about 150–200 psig. Equilibrium is more favorable at lower temperatures but the reaction rate decreases significantly. Also excess water appears to be helpful to achieve high selectivity. If linear olefins are present in the light olefinic feedstock, they will remain substantially unreacted under the above selective reaction temperature and pressure conditions; however, greater severity may result in undesired side reaction of linear olefins. Some recent efforts in the field of hydration reactions have focused on the use of acid medium-pore (e.g.- 5–7A) zeolite catalyst for highly selective conversion of iso-olefin and alcohol starting materials. Examples of such zeolite catalysts are ZSM-4, ZSM-5. ZSM-11, ZSM-12, ZSM-23, ZSM-35, ZSM-50, MCM-22 and zeolite Beta. FCC and TCC operations often employ large pore (8+A), such as zeolite Y or mordenite, which may be employed in the present invention, especially in mixture with the medium pore zeolites. Due to lower acidity as compared to resin catalysts, the zeolites need to be employed at higher reaction temperature to achieve conversion rates substantially equivalent to resin catalysts. These solid acid catalyst particles are much more thermally stable than resin catalyst, are less sensitive to water-to-isobutene ratio, give no acid effluent, and are easily and quickly regenerated.

Developments in zeolite catalysis and hydrocarbon conversion processes have created interest in utilizing olefinic feedstocks for producing $C_4$–$C_5$ tertiary olefins, gasoline, etc. In addition to basic chemical reactions promoted by zeolite catalysts having a ZSM-5 structure, a number of discoveries have contributed to the development of new industrial processes for improved FCC operation to enhance iso-olefin production.

It is an object of the present invention to provide a process and apparatus for continuous operation in preparation of $C_4$+ alkyl alcohols from $C_4$+ olefin with a conventional acid resin catalyst whereby the resin catalyst is protected from impurities such as nitrogen compounds, metals, and coke. It is a further object to use catalyst from such hydration unit operations as makeup for FCC units.

SUMMARY OF THE INVENTION

An improved process has been found for producing tertiary alkanols by catalytic contact of hydration feedstock comprising alkene and water in the presence of at least one deactivating impurity, with thermally stable solid material having acid catalytic activity under hydration conditions.

The preferred improvement comprises a multi-stage process for producing oxygenates in a refinery and increasing production of high octane gasoline range hydrocarbons from cracked FCC petroleum feedstock, including the steps of: contacting the feedstock in a primary fluidized catalyst reaction stage with a mixed catalyst system which comprises finely divided particles of a first large pore cracking catalyst component and finely divided particles of a second medium pore siliceous zeolite catalyst component under cracking conditions to obtain a product comprising intermediate gasoline and distillate range hydrocarbons, and an olefinic gas rich in $C_4+$ iso-olefin; separating the light olefinic gas (which may be recovered as a gas, liquid or mixed phase containing the iso-olefin); and contacting at least a fraction of said olefins and water with particulate catalyst solids consisting essentially of acid medium pore siliceous zeolite catalyst in a secondary fluidized bed reaction stage under hydration reaction conditions, thereby depositing carbonaceous material onto the particulate zeolite catalyst to obtain a coked equilibrium catalyst; withdrawing a portion of partially deactivated equilibrium particulate zeolite catalyst from the secondary reaction stage; and adding said withdrawn coked equilibrium zeolite catalyst to the primary fluidized reaction stage for conversion of crackable petroleum feedstock. Employing this technique, catalyst makeup of a primary stage fluidized catalytic cracking unit and a secondary stage hydration reactor is balanced. For instance, catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5–100 percent by weight of partially deactivated zeolite catalyst based on total amount of catalyst present in the secondary reaction stage is withdrawn from the secondary reaction stage and added to the primary fluidized bed reaction stage. Preferably, the entire makeup added to the FCC catalyst supply system is employed in the hydration reaction zone in a continuous or semibatch manner.

DETAILED DESCRIPTION OF THE INVENTION

Figure 1:
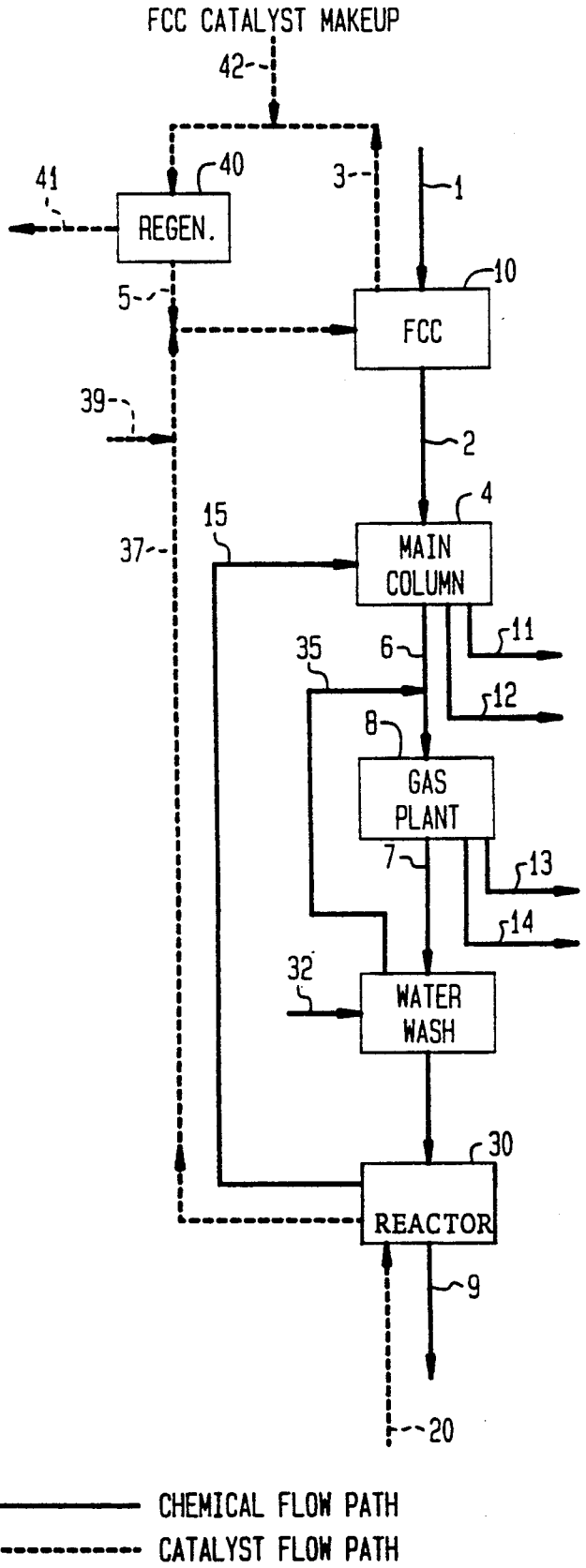
FIG. 1 is an overall flow sheet depicting FCC and alkanol units and their processing relationships.

FIG. 1 illustrates a process scheme for practicing the present invention. The flow of chemicals beginning with the heavy hydrocarbons feed at line 1 is schematically represented by solid lines. The flow of catalyst particles is represented by dotted lines. Chemical feedstock passes through conduit 1 and enters the first stage fluidized bed cracking reactor 10. The feed can be charged to the reactor with a diluent such as hydrocarbon or steam. Deactivated catalyst particles are withdrawn from fluidized bed reaction zone 10 via line 3 and passed to catalyst regeneration zone 40, where the particles having carbonaceous deposits thereon are oxidatively regenerated by known methods. The regenerated catalyst particles are then recycled via line 5 to reaction zone 10. It may be feasible to utilize regenerated catalyst from the FCC unit operations in alkanol unit processing, especially wherein a substantial amount of large pore (e.g.- zeolite Y) catalyst can be beneficial in a pre-hydration guard chamber unit.

A portion of secondary stage catalyst is sent via conduit 37 to first fluid bed reaction zone 10. Fresh medium pore zeolite catalyst can be admixed with the regenerated catalyst as by conduit 39. Also, fresh medium pore zeolite catalyst is added to hydration reaction zone 30 via conduit 20.

Cracked product from the FCC reaction zone 10 is withdrawn through conduit 2 and passed to a main fractionation tower 4 where the product is typically separated into a light gas stream, a middle stream, and a bottoms stream. The middle stream is recovered via conduit 12 and the bottoms stream is withdrawn through conduit 11. The light gas stream is withdrawn through conduit 6 and enters gas plant 8 for further separation. A middle fraction is drawn from the gas plant via conduit 14 and a heavy fraction is withdrawn via conduit 13. A stream comprising $C_4+$ iso-olefin is withdrawn via conduit 7, with optional water washing and enters hydration unit 30 where the stream contacts zeolite solid catalyst particles in a turbulent regime fluidized bed or the like to form the desired alkanol product. Water enters the reactor of unit 30 concurrently with olefin. Alkanol rich (e.g.- TBA) product is removed from the hydration unit 30 through conduit 9.

The catalyst inventory in the FCC reactor preferably comprises predominantly zeolite Y which is impregnated with one or more rare earth elements (REY). This large pore cracking catalyst is preferably combined in the FCC reactor with the ZSM-5 withdrawn from the hydration reactor to obtain a mixed FCC cracking catalyst which provides a gasoline yield having improved octane number and an increased yield of lower molecular weight iso-olefins.

Advantageously, the catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5–100 percent by weight of partially deactivated zeolite catalyst based on total amount of catalyst present in the secondary reaction stage is withdrawn from the secondary reaction stage and added to the primary fluidized bed reaction stage to increase octane by 0.2–5 Research (base 92 Research).

Catalyst inventory in the fluidized catalytic cracking unit may be controlled so that the ratio of cracking catalyst to the added zeolite hydration catalyst is about 1:1 to about 50:1. The fresh catalyst for the hydration unit and the FCC unit has adequate acidity to effect hydration.

In a preferred example, the total amount of fluidized catalyst in the FCC reactor is about ten times as much as the amount of fluidized catalyst in the hydration reactor. To maintain equilibrium catalyst activity in the FCC reactor, fresh Y zeolite catalyst particles are added in an amount of about 1 to 2 percent by weight based on total amount of catalyst present in the FCC reactor. Spent cracking catalyst is then withdrawn for subsequent disposal from the FCC regenerator in an amount substantially equivalent to the combination of fresh REY zeolite catalyst and partially deactivated ZSM-5 catalyst which is added to the reactor.

In a typical example of the present process, an FCC reactor is operated in conjunction with an hydration reactor. The catalyst flow rates per day are adjusted so that about 1.25 percent by weight of fresh large pore zeolite cracking catalyst based on total amount of catalyst present in the FCC reactor is added to the FCC reactor; about 10.0 percent by weight fresh zeolite ZSM-5 catalyst based on total amount of catalyst present in the alkanol unit zeolite reactor is added to the alkanol unit; and about 10.0 percent by weight of zeolite ZSM-5 catalyst based on total amount of catalyst present in the alkanol reactor is withdrawn and added to the catalyst inventory of the FCC reactor. The gasoline range hydrocarbons obtained from the FCC reactor have an increased octane rating (using the R+M/2 method, where R=research octane number and M=motor octane number) of 0.7.

Fluidized Catalytic Cracking-FCC Reactor Operation

In conventional fluidized catalytic cracking processes, a relatively heavy hydrocarbon feedstock, e.g., a gas oil, is admixed with hot cracking catalyst, e.g., a large pore crystalline zeolite such as zeolite Y, to form fluidized suspension. A fast transport bed reaction zone produces cracking in an elongated riser reactor at elevated temperature to provide a mixture of lighter hydrocarbon crackate products. The gasiform reaction products and spent catalyst are discharged from the riser into a solids separator, e.g., a cyclone unit, located within the upper section of an enclosed catalyst stripping vessel, or stripper, with the reaction products being conveyed to a product recovery zone and the spent catalyst entering a dense bed catalyst regeneration zone within the lower section of the stripper. In order to remove entrained hydrocarbon product from the spent catalyst prior to conveying the latter to a catalyst regenerator unit, an inert stripping gas, e.g., steam, is passed through the catalyst where it strips such hydrocarbons conveying them to the product recovery zone. The fluidized cracking catalyst is continuously circulated between the riser and the regenerator and serves to transfer heat from the latter to the former thereby supplying the thermal needs of the cracking reaction which is endothermic. Particular examples of such catalytic cracking processes are disclosed in U.S. Pat. No. 4,927,526 (Anderson et al.), U.S. Pat. No. 5,015,782 and U.S. patent application Ser. No. 07/669,720 filed 15 March 1991 (Harandi et al.), incorporated herein by reference.

Several of these processes employ a mixture of catalysts having different catalytic properties as, for example, the catalytic cracking process described in U.S. Pat. No. 3,894,934 which utilizes a mixture of a large pore crystalline zeolite cracking catalyst such as zeolite Y and shape selective medium pore crystalline metallosilicate zeolite such as ZSM-5. Each catalyst contributes to the function of the other to produce a gasoline product of relatively high octane rating.

A fluidized catalytic cracking process in which a cracking catalyst such as zeolite Y is employed in combination with a shape selective medium pore crystalline include the synthetic faujasite zeolites X and Y with particular preference being accorded zeolites Y, REY, USY and RE-USY.

The shape selective medium pore crystalline zeolite catalyst can be present in the mixed catalyst system over widely varying levels. For example, the zeolite of the second catalyst component can be present at a level as low as about 0.01 to about 1.0 weight percent of the total catalyst inventory (as in the case of the catalytic cracking process of U.S. Pat. No. 4,368,114). In the present invention it can represent as much as 50 weight percent of the total catalyst system.

The catalytic cracking unit is preferably operated under fluidized flow conditions at a temperature within the range of from about 480° C. to about 735° C., a first catalyst component to charge stock ratio of from about 2:1 to about 15:1 and a first catalyst component contact time of from about 0.5 to about 30 seconds. Suitable charge stocks for cracking comprise the hydrocarbons generally and, in particular, petroleum fractions having an initial boiling point range of at least 205° C., a 50% point range of at least 260° C. and an end point range of at least 315° C. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 400° C. must be carried out under vacuum in order to avoid thermal cracking.

Since mixed olefinic alkanol feedstock may contain many impurities, even after treatment in a "Merox" unit and a water wash, the solid acid zeolite hydration catalyst can become highly contaminated after a period of on-line contact with feedstock. Some of the impurities which are absorbed on the zeolite particles are: sulfur and/or nitrogen compounds; metals such as Al, Fe, Na and Mg; and oligomers of olefins and diolefins, such as butadiene, isoprene and cyclopentadiene. Diolefinic compounds and other related hydrocarbons are deposited as coke on the surface and interstices of the zeolite and/or resin catalytic particles. It is therefore an objective of the present process to remove feedstock impurities in a guard chamber or first reaction zone prior to or concurrently with the preparation of alkanols. The first hydration reaction zone preferably comprises at least one reactor containing fluidizable catalyst. The effluent of this reactor may contain catalyst solids, which can be recovered by filtration prior to return to the reactor and/or FCC unit.

In the preferred embodiment, the first reaction hydration zone contains one or more reactors containing a fluidized bed of finely divided zeolite catalyst. The preferred solid acid catalyst particles are aluminosilicate zeolites selected from ZSM-5, ZSM-11, ZSM-35, ZSM-50, MCM-22 and zeolite Beta; however, it is feasible to employ at least a portion of large pore cracking catalyst (eg- REY) with or without the medium pore component.

It is within the scope of the present process and apparatus to adjust the number and types of reactors which contain acid zeolite catalyst in order to optimize both product yield and overall energy consumption as would be practiced by one skilled in the art. If a zeolite guard chamber is employed for hydration feed pretreatment, a temperature up to about 50° C. is preferred for contact with zeolite, especially wherein no water is cofed to the guard chamber, of particular importance in treating $C_5$+ olefins. The mixed olefinic feedstock can contain a significant amount of impurities; however, if desired, the step of washing the feedstream with water can be eliminated.

The optional second hydration reaction zone contains an acid resin catalyst which is preferably a macroreticular polystyrene sulfonic acid resin catalyst. In a preferred embodiment the second reaction zone contains a catalytic distillation column containing polystyrenesulfonic acid resin catalyst in a plurality of fixed bed catalysis-distillation units located in the upper half of the distillation column. The reaction section containing resin catalyst is preferably operated at a temperature about 10° to 30° C. lower than the temperature of the first reaction zone.

In an alternate embodiment, the second reaction zone is not a catalytic distillation column, but rather a single reactor or plurality of reactors. Reactor configuration can take many forms, for example, fixed bed, stirred slurry (see U.S. Pat. No. 3,940,450 to Lee, incorporated herein by reference), swing or ebullated bed. It is within the scope of the present process to employ for the second reaction zone any reactor configuration for sequencing acceptable to the skilled engineer. The present invention contemplates that an acid resin catalyst be employed following a regenerable hydration catalyst, preferably in the second reaction zone. In a preferred embodiment, the resin catalyst is "Amberlyst 15". It is possible to carry the cracking process makeup catalyst particles from storage first to the hydration reactor unit using a stream of hydrocarbon or steam for transport. In addition, moisture present in the pores of addition catalyst may contribute water to the hydration reaction.

A significant improvement is found by adding a preliminary step of contacting the olefin reactants in the liquid phase with oxidatively regenerable solid acid catalyst particles in a preliminary reaction zone under partial hydration conditions to produce an intermediate stream comprising tert-alkanol and unreacted olefin and water, said intermediate stream being substantially free from impurities which reduce catalyst activity. In a preferred embodiment the olefinic feedstock comprises isobutene in an amount of at least about 10 wt. %. Preferably the acid catalyst is aluminosilicate having the structure of ZSM-5, zeolite Beta and/or zeolite Y and is contained in a fluid bed reactor for ease of removal from contact with reactants. Once removed from on-line activity, the acid catalyst is passed to the FCC unit for conversion of heavy hydrocarbons to lighter product, including a mixture of lower olefins.

Although the preferred hydration agent consists essentially of water, other suitable aqueous media substitutes may be used. Although $C_4$ hydrocarbons containing isobutene, is the preferred hydrocarbon feed, other $C_5$–$C_7$ tertiary olefins such as 3-methyl-2-butene can be hydrated in the present process.

Figure 2:
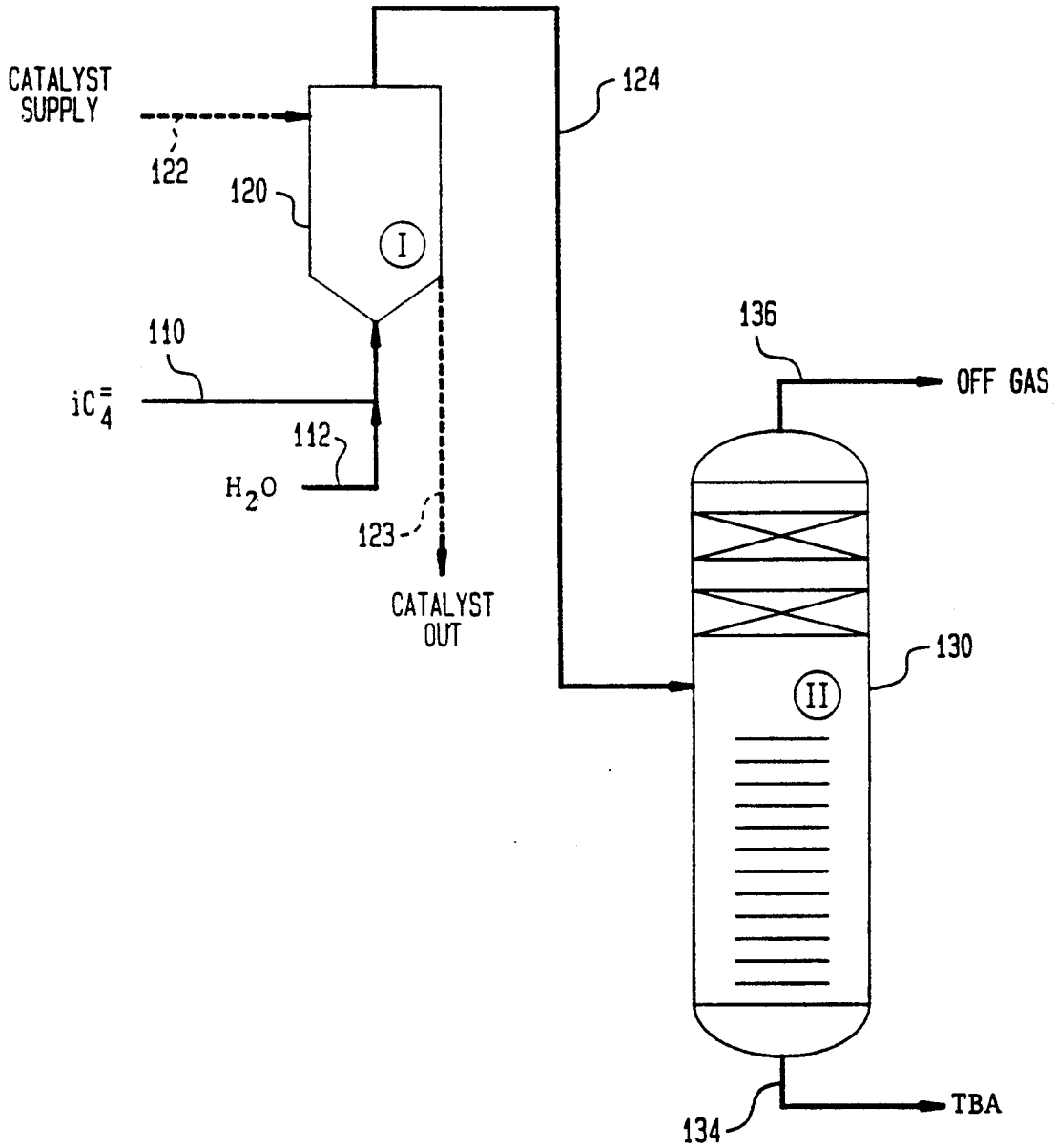
FIG. 2 is a schematic diagram of a preferred embodiment of the hydration unit of the present process, showing major operating units and flow of reactants and chemical products.

Referring to FIG. 2, a pre-washed $C_4$+ aliphatic hydrocarbon feedstock stream 110 containing isobutene is fed with water stream 112 to a Stage I hydration reactor 120 for contact with a solid zeolite from supply conduit 122 and the mixed alcoholic $C_4$+ hydrocarbon feedstream contacts the solid catalyst within this reaction zone at predetermined reaction zone conditions of temperature and pressure to convert at least a portion of the feedstream to TBA. It is understood that fluidization can be effective in liquid-solid slurry or a turbulent gas-solid catalyst bed. Impurities present within the feedstock are effectively removed from the partially converted feedstream by the solid acid catalyst. Catalyst particles entrained in the reactor effluent can be recovered by filtration. Catalyst withdrawn from Stage I reactor via conduit means 123 is transferred to the FCC unit operations via conduit 37, as discussed above.

Intermediate stream 124 containing TBA and unreacted $C_4$ hydrocarbons and alcohol is withdrawn from reaction zone 120 and enters Stage II catalytic distillation column 130. The temperature of the intermediate stream may be adjusted prior to entering the distillation column. In distillation column 130 a substantial portion of unreacted $C_4$ hydrocarbons and alcohols are converted to TBA over a polystyrenesulfonic acid resin catalyst such as "Amberlyst 15". In a preferred embodiment acid resin catalyst is placed in an upper rectifying section 32 of a debutanizer column used for stabilizing the alkanols. A product stream comprising TBA can be withdrawn from a lower portion of distillation column 130 by line 134. Unreacted light gases are removed as by line 136. Typical hydration unit operations are described in U.S. Pat. Nos. 4,423,251; 4,334,890; 4,484,013; 4,499,313; 4,783,555; incorporated herein by reference. At least a portion of alcohol can be added to the secondary reactor 130 via line 124.

To illustrate the common problem of catalyst poisoning when a polysulfonic acid resin catalyst is employed in the hydration process, TBA resin catalyst unit is operated in a continuous fashion for a period of six months. Isobutene containing hydrocarbon feed is purified in a "Merox" unit and water-washed prior to entering the TBA reactor. Conversion decreases from 93% to 52% during the six month period. Analysis identifies the contaminants on the resin catalyst. The major contaminants are nitrogen compounds, which are responsible for about 60% of the catalyst deactivation. The concentration of nitrogen on the deactivated resin catalyst is about $25\times10^3$ ppm Metals such as Al, Fe, Na and Mg account for about 10% of the deactivation. The source of such metals is mainly from the water wash tower. The concentration of the metals on the deactivated catalyst is about $15\times10^2$ ppm. The third type of contaminant is coke. Coke is formed on the resin catalyst due to the presence of such compounds as cyclopentadiene and isoprene in the hydrocarbon feedstock. Continuous monitoring of the feedstock is necessary to control particularly the diolefinic $C_5$ hydrocarbon content. One of the advantages of the present process is that coke formation occurs primarily on the zeolite catalyst.

It is also observed that acetone and nitrile compounds are major contaminants in the hydrocarbon feedstocks which have been water washed. For example, a feed sample may contain 190 ppm acetone, 3 ppm acetonitrile and 16 ppm propionitrile. An advantage of the present process is that the hydrocarbon feedstock does not have to be water washed.

The present process is advantageous in reducing impurities in the olefinic gas from FCC operations by sorption of the impurities; thereby improving quality of FCC gasoline or the like. It is understood by those skilled in the art that the olefinic reactant stream for hydration may be recovered from the FCC unit main column overhead drum, or other accumulator in the FCC/unsaturated gas plant system, either as a draw stream or treatment of the entire unit effluent.

While the invention has been described by specific examples and embodiments, there is no intent to limit the inventive concept except as set forth in the following claims.

I claim:

1. A continuous multi-stage process for increasing octane quality and yield of liquid hydrocarbons from an integrated fluidized catalytic cracking unit and hydration reaction zone comprising:

contacting heavy hydrocarbon feedstock in a primary fluidized bed reaction stage with cracking catalyst comprising particulate solid large pore acid aluminosilicate zeolite catalyst at conversion conditions to produce a hydrocarbon effluent comprising gas containing $C_2$–$C_6$ olefins, intermediate hydrocarbons in the gasoline and distillate range, and cracked bottoms;

regenerating primary stage zeolite cracking catalyst in a primary stage regeneration zone and returning at least a portion of regenerated zeolite cracking catalyst to the primary reaction stage;

reacting an olefinic stream containing at least one iso-olefin with water in a secondary fluidized bed hydration reactor stage in contact with a closed fluidized bed of acid zeolite catalyst particles comprising solid acid zeolite under hydration reaction conditions to effectively convert said iso-olefin to alkyl alkanol;

adding fresh acid zeolite particles to the secondary stage reactor in an amount sufficient to maintain average equilibrium catalyst particle activity for effective alkanol synthesis reaction without regeneration of the secondary catalyst bed;

withdrawing a portion of equilibrium catalyst from the secondary fluidized bed reactor stage; and passing said withdrawn catalyst portion to the primary fluidized bed reaction stage for contact with the petroleum feedstock.

2. A process according to claim 1 wherein equilibrium catalyst withdrawn from the second fluidized bed reaction stage is in partially deactivated form and wherein reaction severity conditions are maintained.

3. A process according to claim 1 wherein fresh catalyst is added to the second fluidized bed reaction stage to maintain acid activity of the equilibrium catalyst.

4. A process according to claim 2 including the steps of separating primary stage effluent to recover an olefinic stream containing at least one $C_4$+ iso-olefin; and washing said olefins from the primary reaction stage to remove water-soluble impurities prior to contacting zeolite catalyst in the secondary reaction stage.

5. A process according to claim 3 wherein said fresh catalyst comprises ZSM-5 and wherein equilibrium catalyst has deposited thereon up to about 10 wt % of coke.

6. A continuous multi-stage process for increasing production of high octane gasoline range hydrocarbons from crackable petroleum feedstock comprising:

contacting the feedstock in a primary fluidized catalyst reaction stage with a mixed catalyst system finely divided particles of a first large pore cracking catalyst component and finely divided particles of a second medium pore siliceous zeolite catalyst component under cracking conditions to obtain a product comprising intermediate gasoline and distillate range hydrocarbons, and an olefinic gas rich in $C_4$+ iso-olefin;

separating the olefinic gas and contacting at least a fraction of said olefins together with water with particulate catalyst solids consisting essentially of acid medium pore siliceous zeolite catalyst in a secondary fluidized bed reaction stage under hydration reaction conditions, thereby depositing carbonaceous material onto the particulate zeolite catalyst to obtain a coked equilibrium catalyst;

withdrawing a portion of partially deactivated equilibrium particulate zeolite catalyst from the secondary reaction stage; and adding said withdrawn coked equilibrium zeolite catalyst to the primary fluidized reaction stage for conversion of crackable petroleum feedstock, whereby catalyst makeup of a primary stage fluidized catalytic cracking unit and a secondary stage hydration unit is balanced; wherein catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5–100 percent by weight of partially deactivated zeolite catalyst based on total amount of catalyst present in the secondary reaction stage is withdrawn from the secondary reaction stage and added to the primary fluidized bed reaction stage.

7. A process for integrating the catalyst inventory of a fluidized catalytic cracking unit and a fluidized bed reaction zone for hydration of olefins to enhance production of iso-olefins, the process comprising;

maintaining a primary fluidized bed reaction stage containing acid cracking catalyst comprising a mixture of crystalline aluminosilicate particles having a pore size greater than 8 Angstroms and crystalline medium pore zeolite particles having a pore size of about 5 to 7 Angstroms;

converting a feedstock comprising a petroleum fraction boiling above about 250° C. by passing the feedstock upwardly through the primary stage fluidized bed in contact with the mixture of cracking catalyst particles under cracking conditions of temperature and pressure to obtain a product stream comprising cracked hydrocarbons;

separating the product stream to produce olefinic gas containing $C_4$+ olefin gas, intermediate products containing gasoline and distillate range hydrocarbons, and a bottoms fraction;

maintaining a secondary fluidized bed reaction stage containing finely divided olefins conversion catalyst consisting essentially of crystalline medium pore zeolite particles having an average alpha value of about 1 to 10 and a pore size of about 5 to 7 Angstroms;

contacting at least a portion of said olefin gas and an aqueous reactant with said medium pore zeolite particles in the secondary fluidized bed reaction stage under hydration reaction conditions to obtain tertiary alkanol product;

withdrawing from the secondary stage a portion of catalyst particles; and adding the zeolite catalyst particles to the primary fluidized bed reaction stage containing cracking catalyst.

8. A process according to claim 7 wherein the catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5–100 percent by weight of partially deactivated zeolite catalyst based on total amount of catalyst present in the secondary reaction stage is withdrawn from the secondary reaction stage and added to the primary fluidized bed reaction stage to increase octane by 0.2–2 Research (base 92 Research).

9. A process according to claim 7 wherein $C_4$ olefins comprise a major amount of the olefinic light gas in the secondary fluidized bed reaction stage.

10. The process of claim 7 including the steps of contacting the olefinic stream and aliphatic alcohol in a first hydration stage under partial hydration conditions with a acid solid catalyst to convert a major amount of the isoalkene to $C_5$+ tertiary-alkyl alkanol;

recovering a reactant effluent from the first stage containing alkanol product, unreacted alcohol and unreacted olefin including isoalkene;

charging the first hydration stage effluent to a second stage catalytic distillation column containing solid acid resin hydration catalyst in a plurality of fixed bed catalysis-distillation zones to complete substantially full hydration of isoalkene;

recovering $C_5$+ alkanol as a liquid from the catalytic distillation column.

11. The process of claim 10 wherein the olefin feedstock contains impurity selected from nitrogen compounds; Al, Fe, Na and/or Mg metal; butadiene, isoprene or cyclopentadiene.

12. The process of claim 10 wherein the first hydration reaction stage concurrently removes feedstock impurities.

13. The process of claim 10 wherein the first hydration stage is maintained at least 5° C. higher than a second reactor zone.

14. The process of claim 10 wherein the second stage catalytic distillation column reaction zone operates at a temperature about 10°–30° C. lower than the first stage.

15. The process of claim 7 wherein olefin gas recovered from the primary stage contains at least one sulfur or nitrogen compound.

16. The process of claim 1 wherein said iso-olefin comprises tertiary amylene.

17. The process of claim 1 wherein catalyst in the primary and secondary stages is predominantly zeolite Y.

18. A continuous multi-stage process for increasing octane quality and yield of liquid hydrocarbons from an integrated fluidized catalytic cracking unit and hydration reaction zone comprising:

contacting heavy hydrocarbon feedstock in a primary fluidized bed reaction stage with cracking catalyst comprising particulate solid acid zeolite catalyst at conversion conditions to produce a hydrocarbon effluent comprising containing $C_2$–$C_6$ olefins;

regenerating primary stage zeolite cracking catalyst in a primary stage regeneration zone and returning at least a portion of regenerated zeolite cracking catalyst to the primary reaction stage;

pretreating an impure olefinic reactant stream containing at least one iso-olefin in a secondary stage guard chamber prior to hydration in a secondary hydration stage in contact with acid catalyst under hydration reaction conditions to convert said iso-olefin to alkyl alkanol;

adding acid zeolite particles to the secondary stage guard chamber for removal of olefinic stream impurities prior to hydration reaction;

withdrawing a portion of zeolite catalyst from the secondary stage guard chamber;

passing said withdrawn zeolite catalyst portion to the primary fluidized bed reaction stage for contact with the petroleum feedstock.

19. The process of claim 18 wherein catalyst in the primary stage and secondary stage guard reactor is predominantly zeolite Y.

* * * * *